US005660439A

United States Patent [19]

Unwalla

[11] Patent Number: 5,660,439

[45] Date of Patent: Aug. 26, 1997

[54] INTEGRATED SEAT AND BACK AND MECHANISMS FOR CHAIRS

[76] Inventor: Jamshed Unwalla, 175 Elderwood Trail, Oakville, Ontario, Canada, L6H 5W4

[21] Appl. No.: 563,063

[22] Filed: Nov. 27, 1995

[30] Foreign Application Priority Data

Jan. 4, 1995 [GB] United Kingdom ..... 9500022

[51] Int. Cl.[6] ..... A47C 1/032

[52] U.S. Cl. ..... 297/316; 297/320; 297/321; 297/322; 297/300.2; 297/300.5

[58] Field of Search ..... 297/320, 321, 297/322, 300.2, 300.4, 300.5

[56] References Cited

U.S. PATENT DOCUMENTS

| | | | |
|---|---|---|---|
| 4,451,085 | 5/1984 | Franck et al. | 297/300.5 |
| 4,640,547 | 2/1987 | Fromme | 297/320 X |
| 4,640,548 | 2/1987 | Desanta | 297/322 X |
| 4,685,730 | 8/1987 | Linguanotto | 297/320 X |
| 4,709,962 | 12/1987 | Steinmann | 297/320 X |
| 4,758,045 | 7/1988 | Edel et al. | 297/322 X |
| 4,854,641 | 8/1989 | Reinemann et al. | 297/300.2 X |
| 4,966,411 | 10/1990 | Katagiri et al. | 297/321 X |
| 4,988,145 | 1/1991 | Engel | 297/321 X |
| 5,263,767 | 11/1993 | Asbjørsen et al. | 297/320 |
| 5,397,165 | 3/1995 | Grin et al. | 297/322 X |
| 5,423,594 | 6/1995 | Hancock et al. | 297/320 X |
| 5,425,566 | 6/1995 | Buchasz | 297/320 X |

*Primary Examiner*—Peter M. Cuomo
*Assistant Examiner*—Rodney B. White

[57] ABSTRACT

Integrated seat, back and mechanisms are provided for tilting chairs, and other similar seating. The chair has a base, a seat, a back, a back support and a mechanism which interconnects the seat, back and back support, and imparts a predetermined synchronous movement to the seat and back, i.e. rearward tilting of the seat and simultaneous rearward tilting of the back. The chair back has rotation means for rotatably connecting the chair back to the back support. The rotation is about a rotation axis which passes through the upper body of a person when the person is sitting on the seat and resting against the front of the chair back. The bottom portion of the chair is preferably guided so that the bottom may move along an arc between a first position and a second position which is forward and lower than the first position. The mechanism also has a very large range of movement allowing the user a continuous angular variation from forward inclination to full reclined inclination. The mechanism also allows the rate at which the back inclines with respect to the seat in various segments of the inclination range to be different. The seat and back are contoured specifically to accommodate a larger population, with a higher level of comfort, i.e. to provide a pleasing pressure distribution pattern, that varies proportionately and continuously with the tilting motion of the chair, throughout the movement range provided by the mechanism. The seat, back and mechanism thus form an integral part of the chair, in as much as the contour has been worked out in connection with the movement as stated above and some parts of the mechanism may be embedded into the seat and back. When all the above parameters act in concert they impart a very high comfort level and uniformity of support in either the static or the dynamic conditions.

13 Claims, 5 Drawing Sheets

INTEGRATED SEAT AND BACK AND MECHANISMS FOR CHAIRS

FIELD OF INVENTION

The present invention relates to chairs, and in particular to chairs with integrated seats, backs and tilting mechanisms, required to impart to the user comfortable and healthy movements. Although used for a variety of purposes, such devices are very common in office environments.

BACKGROUND TO THE INVENTION

Various types of synchronous seating mechanisms are known which allow the seat of a chair to tilt, whilst the back tilts at a faster rate than the seat and at the same time the feet of a seated person may rest on the floor. Some seating mechanisms also have built in a biasing means which forces the chair into a normally upright or forward position. Most synchronous tilt chairs have their synchronous axis either under the chair, or close to and a little below the center of the hip joint axis of the occupant as disclosed in U.S. Pat. No. 4,776,633 to Knoblock et al. It is normally about this synchronous axis that the chair back or a portion of the chair back rotates with respect to the seat or a portion thereof. Therein lies the main difference between prior synchronous chairs and the one disclosed in this application.

Discussion to the prior art and the present invention is made in reference to the drawings, in which FIG. 1A is a schematic showing a person seated upright in a chair.

Figure 5:
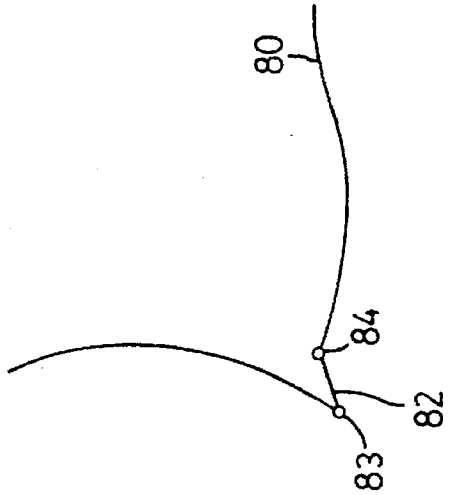
Figure 3A:
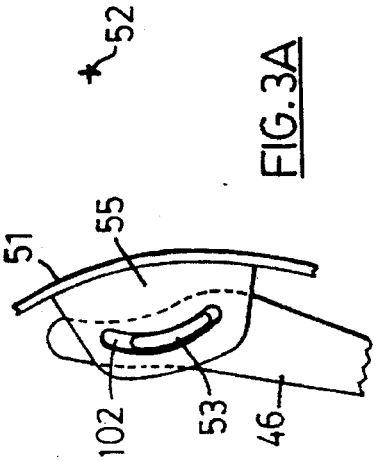
FIG. 3A is a cross-sectional representation of a detail of the embodiment shown in FIG. 3.
Figure 4:
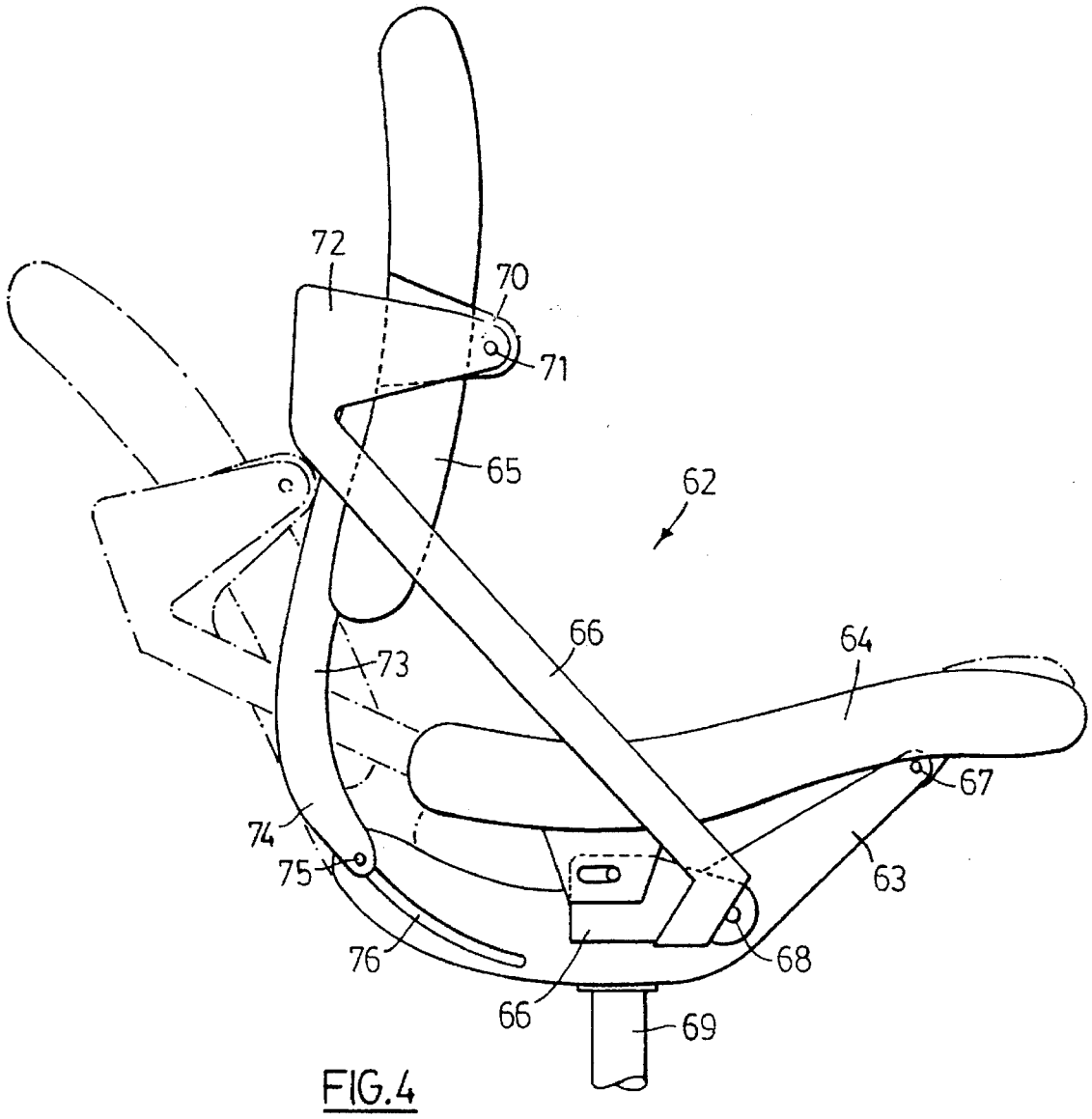
FIG. 4 is a side view representation of another embodiment of the present invention.

FIG. 5 which appears between FIGS. 3A and 4, is a diagrammatic representation of the alternative seat and chair back in a single piece configuration.

Figure 6:
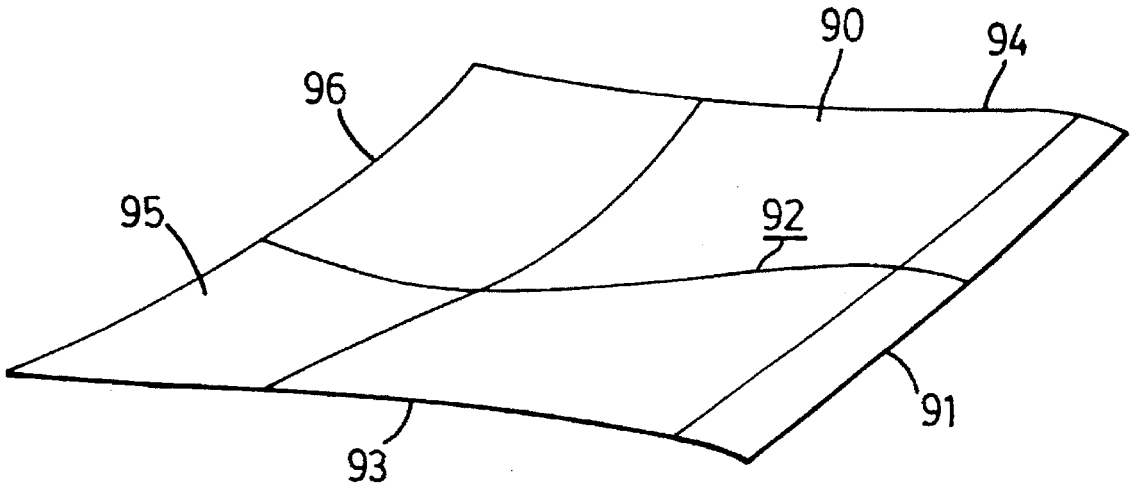

FIG. 6 is a schematic showing a preferred seat contour with a flat front edge, for use with the present invention.

Figure 7:
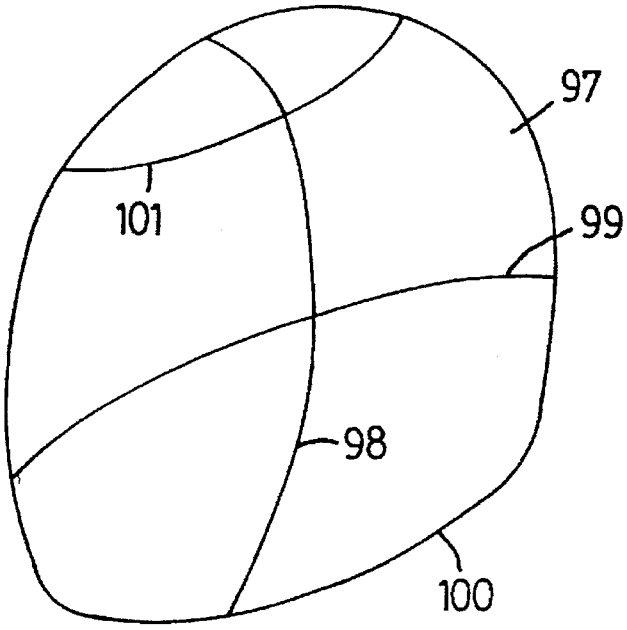

FIG. 7 is a schematic showing the contour of the front of a chair back, with a straight bottom edge, for use with the invention.

FIG. 1A to 1C, 2A and 2B relate to a general discussion concerning chair construction. The remaining figures relate to the present invention or preferred embodiments thereof.

Figure 1A:
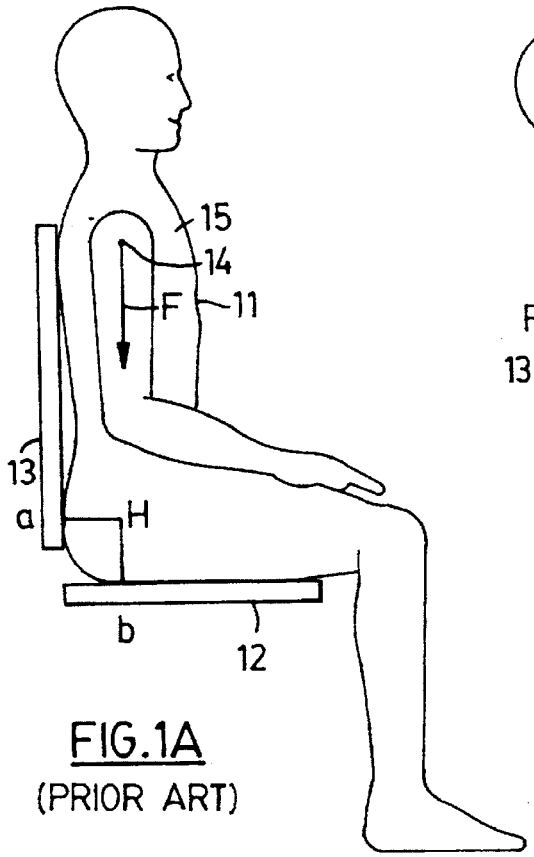
FIG.1A (PRIOR ART)
FIG. 1B is a schematic showing a person seated in a reclined position in a chair.
FIG. 1C is a schematic showing a person seated in a recline position in a chair which has flexible material on the chair back.
Figure 1B:
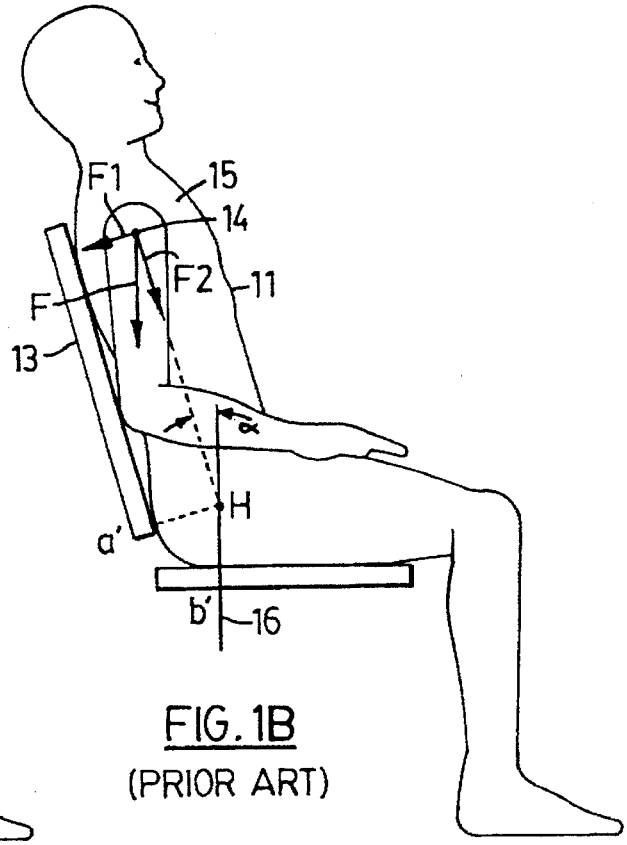
FIG.1B (PRIOR ART)

FIG. 1A shows an occupant 11 of a chair sitting upright in a chair which has a seat 12 and back 13, and FIG. 1B, shows a the same occupant sitting in the chair when reclined. The occupant 11 has a center of gravity 14 of the upper body 15 and force F is exerted by occupant 11 on the chair seat 12. Angle $\alpha$ is the angle of inclination of the upper body 15 with the vertical (line 16 in FIG. 1B). In the reclined position shown in FIG. 1B, force F may be considered as component force F1 which is perpendicular to the back of the chair 13 and component force F2 which is parallel to the back of the chair. Thus, F1=F Sin$\alpha$ and F2=F Cos$\alpha$. When occupant 11 is seated upright as in FIG. 1A, $\alpha$=0° and therefore, F1=0, and F2=F. When $\alpha$=90°, i.e. in a lying down position (not shown) where the seat back 13 is reclined until parallel to seat 12, F1=F and F2=0. Therefore, force F1 increases proportionately to the sine of the angle of inclination $\alpha$, i.e. the larger the inclination of the chair back the greater is the pressure felt on the occupant's back.

Figure 1C:
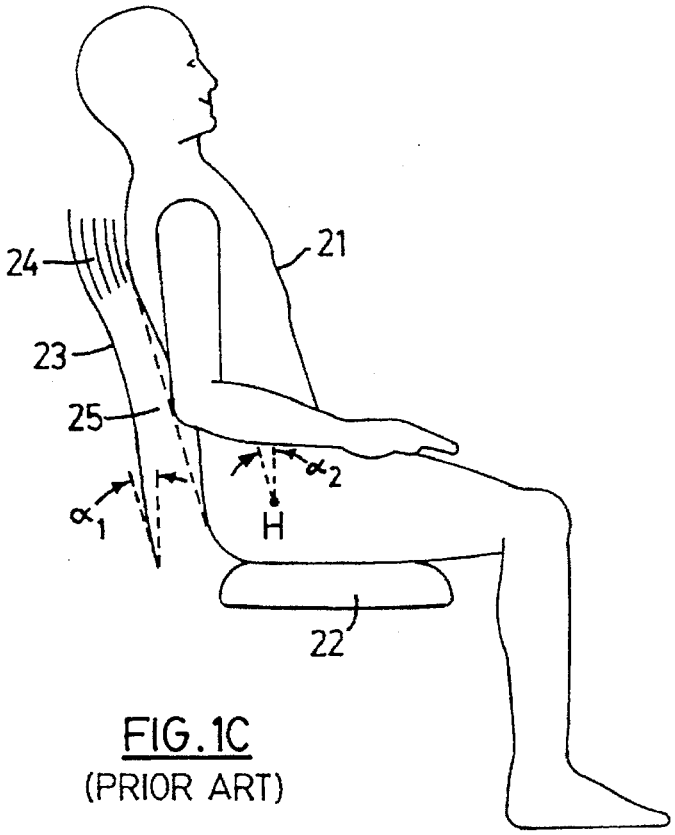
FIG.1C (PRIOR ART)

With reference to FIG. 1C, the occupant 11 is shown in the inclined position, as in FIG. 1B but the chair has a back with cushioning or flexible material thereon. As in many prior art chairs, back 23 of the chair is allowed to rotate with respect to seat 22 about point H which is the center of the hip joint of the seated occupant. If the back 23 of the chair is allowed to incline by an angle $\alpha_1$, the upper body of the occupant inclines by an angle $\alpha_2$, where $\alpha_2>\alpha_1$. This is due to the fact that the cushioning material 24 compresses under the increasing force F1 as the inclination angle increases, and the buttock of the occupant 21 remains fixed to the seat. This presupposes that the back of the occupant does not flex. In actual fact the back of the occupant slumps into the chair, as shown by the dotted line 25 in FIG. 1C. As a result, the lower back of the occupant loses its support and the hip joint of the occupant's pelvic bone rotates by an angle $\alpha_3$, which is even greater than $\alpha_2$.

Figure 2A:
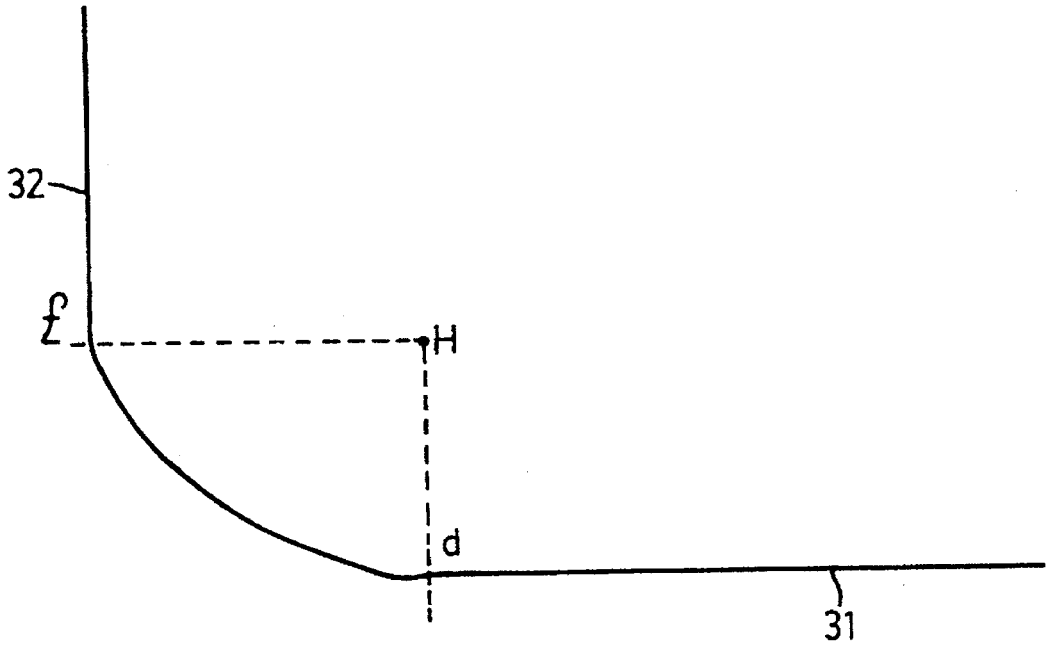
FIG. 2A (PRIOR ART)
FIG. 2A is a line drawing of a prior art chair in the upright position, with a pivot point for the chair back at point H.

The problems of the prior art chairs is further illustrated by reference to FIGS. 2A and 2B. If a chair is to be truly comfortable, then ideally the chair should follow the natural movement of the body. The included angle between the seat and the chair back for most chairs falls in the range of about 85 degrees minimum to 120 degrees maximum. In the human body the angle (between the upper and lower body) could vary easily from as low as 20 degrees to as high as 180degrees. To illustrate whether a body follows the relationship of the chair back and seat as the chair back reclines,the movement of the chair can be checked at two points, i.e. when the included angle is 90degrees (i.e. the chair back is upright) and when the included angle is 180 degrees (i.e. the chair back is horizontal). At 180 degrees, it is desirable that the body lies on a roughly flat surface. So the movement of the chair back, if theoretically extrapolated from the upright 90 degree position to the horizontal 180 degree position should bring the back of the chair roughly level with the seat. Most chairs on the market today try to have the axis of rotation of the chair back, with respect to the seat, roughly coincident with the hip joint of the user. With reference to FIG. 2A, the point H is the center, of the hip joint axis of the user, line 31 represents the seat of the chair and line 32 represents the back of the chair in the upright position with respect to the seat. Line Hf is perpendicular to line to 32 and line Hd is perpendicular to line 31, with points f and d being intersection points on lines 32 and 31 respectively. For the human anatomy Hf is greater than Hd in a typical user.

Figure 2B:
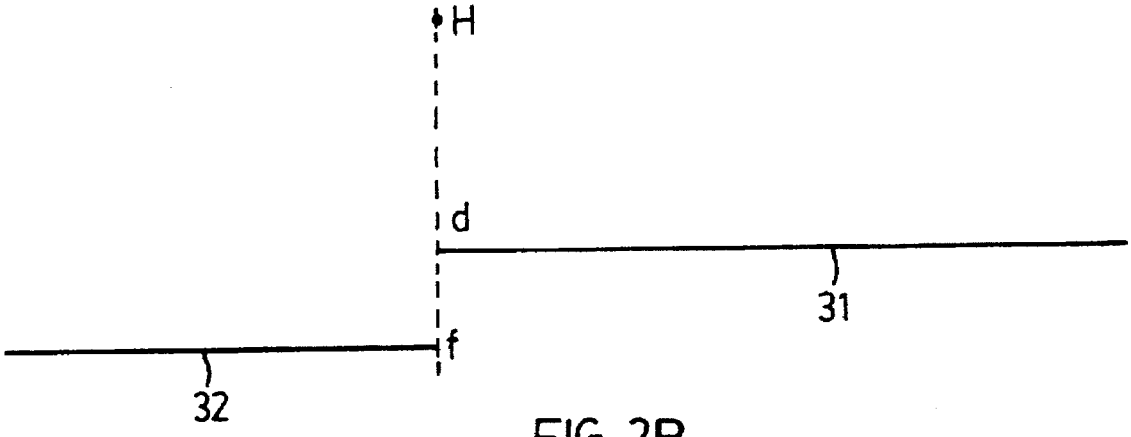
FIG. 2B (PRIOR ART)
FIG. 2B is a line drawing of the chair of FIG. 2A, with the chair back tilted to a position parallel to the seat.

In FIG. 2B, the back 32 of the chair is allowed to rotate about the point H until the angle between the seat 31 and the chair back 32 is 180 degrees. It can be seen that since Hf is not equal to Hd there is a displacement df between the seat and the chair back. For distance df varies from about 36 to about 43 mm in most of the human population. This distance is substantial. The only time that the seat 31 and chair back 32 would not have any displacement is when Hf is equal to Hd. However, this generates a condition known as shirt pull or separation. Thus a simple pivot, even if it is coincident with the hip joint of the user, will not satisfy the criteria for following the natural body movement. It will result in some slip or separation that is correlated to the angle opened. This results in an unnatural or uncomfortable motion, and fatigues the user at a faster rate compared to a motion that follows the natural body movements.

Further, with a mechanism that does not follow the natural body movements it is very difficult to have an extended range of movement and a ratio of synchronous movement of chair back to seat equal to about 3:1.

The present invention is directed to alleviating the aforementioned difficulties with the provision of an improved chair tilting mechanism.

Disclosure of the Invention

For the purposes of the description herein, the terms "upper", "lower", "rear", "front", "vertical", "horizontal", refer to positions and directions normally used by those skilled in the art. The terms "right", "left", "rear" and "front" are directions when viewed from the back of a chair, looking forward to the seat. The term "base" may include appendages thereto.

The present invention provides a chair for a person with an upper body and a back, in which the chair has upward and downward directions, forward and rearward directions and has a base, a chair seat, a chair back, and chair back support means; in which the chair seat has two sides, a front portion in the forward direction and a rear portion in the rearward direction; and in which the back support means is pivotable about a back support means axis which is forward of the rear portion of the seat and parallel to the side-to-side direction of the seat; in which the chair back has a top, a front which faces the forward direction, a rear which faces the rearward direction, a bottom which is downward relative to the top, and in which the bottom is closer to the rear portion of the seat than any other part of the chair back, the improvement wherein:

the chair back has rotation means for rotatably connecting the chair back to the back support means, the rotation being about a rotation axis which is parallel to the back support means axis, and which passes through the upper body of a person when the person is sitting on the seat and when the back of the person is resting against the front of the chair back.

In a preferred embodiment, the bottom of the chair back is attached to means for moving the bottom in a predetermined path.

In another embodiment the seat is interconnected to the base and the back support means by interconnection means such that the rear portion of the seat moves downwards when the back support means moves rearwards about the back support means axis.

In a further embodiment the interconnection means is selected from the group consisting of i) first pivot means at the front portion of the seat for pivotally connecting the front portion of the seat to the base, second pivot means for pivotally connecting the back support means to the base, and first slidable connection means for slidably connecting the seat to the back support means and allowing relative movement at the first slidable connection means of the seat and back support means in a direction substantially parallel to the forward and rearward direction, ii) first pivot means for pivotably connecting the seat to the back support means, second pivot means for pivotally connecting the back support means to the base, and first slidable connection means at the front portion of the seat for slidably connecting the front portion of the seat to the base and allowing relative movement at the first slidable connection means of the seat and base in a direction substantially parallel to the forward and rearward direction and iii) first pivot means at the front portion of the seat for pivotally connecting the front portion of the seat to the base, first slidable connection means for slidably connecting the back support means to the base, and second pivot means for pivotally connecting the seat to the back support means and allowing relative movement at the first slidable connection means of the back support means and the base in a direction substantially parallel to the forward and rearward direction; and translation means for allowing simultaneous movement of the bottom of the chair back along a path between a first position to a second position which is downward and forward of the first position.

In yet another embodiment the second position is under the rear portion of the seat.

In one embodiment the front portion of the seat has first pivot means for pivotally connecting the front portion of the seat to the base, and the underside of the seat has a first slidable connection means for slidably connecting the underside of the seat to the back support means and allowing relative movement of the seat and back support means in a direction substantially parallel to he forward and rearward direction; and the back support means has second pivot means for pivotally connecting the back support means to the base.

In another embodiment the translation means comprises a depending arm attached to the chair back, in which the depending arm has an end which is distal to the rotation means, and in which the end has second slidable connection means for slidably connecting the end to a member, said member being selected from the group consisting of the base and an appendage attached to the underside of the rear portion of the seat, said second slidable connection allowing movement of the end of the depending arm along a path between the first position and the second position.

In one embodiment the end of the depending arm is slidably connected to the base.

In another embodiment the end of the depending arm is slidably connected to an appendage attached to the rear portion of the seat, preferably the underside of the rear portion of the seat.

In a further embodiment the path between the first and second positions of the second slidable connection means is in an arc which is concave towards a position above the seat and forward. For example the arc may be a circular arc with a center level with a hip of the person when seated.

In another embodiment the second slidable connection means is a mating slot and slot follower, preferably a mating slot and pin.

In yet another embodiment the translation means comprises a link hingedly connected to the bottom portion of the chair back and hingedly connected to the rear portion of the seat, the link allowing movement of the bottom of the chair back along a path between the first position and the second position.

In a further embodiment the translation means is a link and the hinges are so-called live hinges.

In another embodiment the link is collapsible in the direction between the two hinges.

In yet a further embodiment the first slidable connection means is a mating slot and slot follower, preferably a mating slot and pin.

In yet another embodiment the rotation means comprises i) an arcuate slot in a plate, the slot having a center of the arc at the rotation axis, and ii) a mating slot follower, one of the plate and the slot follower being attached to the chair back and the other of the plate and slot follower being attached to the back support means, said arcuate slot being at the rear of the chair back.

In another embodiment the slot follower is selected from the group consisting of i) an arcuate protuberance of smaller arc length than the slot and ii) at least two pins.

In a further embodiment the rotation means comprises third pivot means in which the back support means and the chair back are pivotally connected at the rotation axis.

In another embodiment the bottom of the chair back follows an approximately elliptical path, whilst the longitudinal axis of the chair back remains approximately tangential to the elliptical path. Preferably, the center or the focus of the ellipse of which the elliptical path is a segment, is approximately coincident with the hip joint of a typical seated user.

Although the chair may have a chair seat which is fixed, i.e. the rear portion is not movable in the downwards and upwards directions, the buttocks of an occupant of such a seat have a tendency to slide forward when the seat back is inclined backwards. For this reason it is preferred that the rear portion of the seat be movable downwards when the chair back is inclined backwards. In order to allow synchronous movement of the seat and chair back, a connection means is preferably provided for the seat, chair back, back support means and base are sometimes referred to herein as a tilting mechanism. The rearward tilting of the seat produces a simultaneous rearward tilting of the chair back, which is more pronounced than the tilting of the seat. In one embodiment, for example, for each degree of rotation of the seat with respect to the base, the chair back may rotate from two to four degrees, preferably about three degrees with respect to the base. In addition, the chair back preferably moves downwards and forwards, e.g. toward the underside of the seat in a predetermined and controlled manner. When a seated person exerts a rearward force onto the chair back with their back, the seat begins to incline rearwards and the back of the chair rotates with respect to the seat. At the same time the lower portion of the back of the chair preferably moves proportionally downwards and forwards, e.g. towards the underside of the seat. In this way the body of the seated person is maintained in substantially a correct posture at all angles of inclination. In a preferred embodiment the chair seat and chair back are contoured to maintain the seated persons back to a pressure distribution pattern which minimizes local build up of pressure in unwanted areas of the back as angle of inclination of the chair back increases.

It will be understood by those skilled in the art that it is desirable to add a biasing means which forces the chair into a normally upright and/or forward position. Preferably the mechanism also includes a tension adjusting device for the biasing means to vary the tilting force which resists the rearward tilting moment exerted by the occupant of the chair. Preferably, the chair can be adjusted to take into account the varying weights of occupants and their preferences for feel.

It is believed that the tilting mechanism of the present invention can provide a greater range of chair back to seat relative synchronous movement compared to synchronous chairs of the prior art, and a greater ratio of synchronous movement of chair back to seat equal to about 3:1 instead of the normal 2:1. This allows the seat inclination to extend from negative inclination, with a low included angle between seat and chair back, i.e. sitting fully upright or slightly leaning forward in task oriented positions or forward stretch, to a positive inclination of the seat, with a large included angle between the seat and chair back, e.g. fully reclined or relaxed sitting position or rearward stretch, while minimizing the aforementioned difficulties of shirt pull and back slump of the occupant.

The seat and chair back can be separate pieces or they can be of a single piece design. The integral manner in which the seat, chair back and the mechanism are interrelated, allows the chair to function as an integral whole. The result is a improved support for the body of the seated person over substantially the entire range of movement of the mechanism, and improved comfort. The contour of the seat and the chair back are also contributing factors in providing improved comfort, support and pressure distribution patterns of the chair. The tilting mechanism of the present invention and contouring of the seat and chair back in combination provide even greater support and comfort.

The seat may be constructed to incline from a negative inclination, i.e. tilted forward, to a positive inclination, i.e. tilted backwards for reclined seating. This increased range of operation for the mechanism broadens the usability of the chair. As indicated above, the position of the rotation axis is located with reference to the seated occupant, after accounting for deformation of any cushioning that may be on the chair back and seat. This is because the comfort of the chair is affected by the presence of any padding, e.g. foam, and by the properties of the padding, e.g. its density, hardness, elasticity, thickness, contour and the like.

The present invention is efficient in use, economical to manufacture, capable of long operating life, and very well adapted for the proposed use.

As indicated hereinbefore the bottom of the back of the chair of the present invention is caused to progressively move forwards and downwards as the angle of inclination of the chair back increases. This tends to allow the spine of the chair occupant to remain supported through the entire back inclination and the hip joint to rotate by approximately the same angular displacement as the back of the chair. Such movement also tends to allow the pressure distribution on the occupant's back to be maintained whilst maintaining the body in the required posture. The movement of the chair back with respect to the seat is not a simple rotation, but a combination of rotation and translation. Also as indicated, the hardness of the flexible chair back padding material and its contour will affect the comfort of the occupant. The higher the hardness of the chair back material, the less the deformation, and vice-versa. As regards the contour, as has been previously discussed, the pressure on the chair back increases with increasing inclination. The preferred contour is one in which the maximum surface area of the occupant's back comes into contact with the chair back at any inclination and the various parts of the chair back are subjected to pressures based on their respective load bearing capabilities. There are similar considerations regarding the seat padding material.

Figure 3:
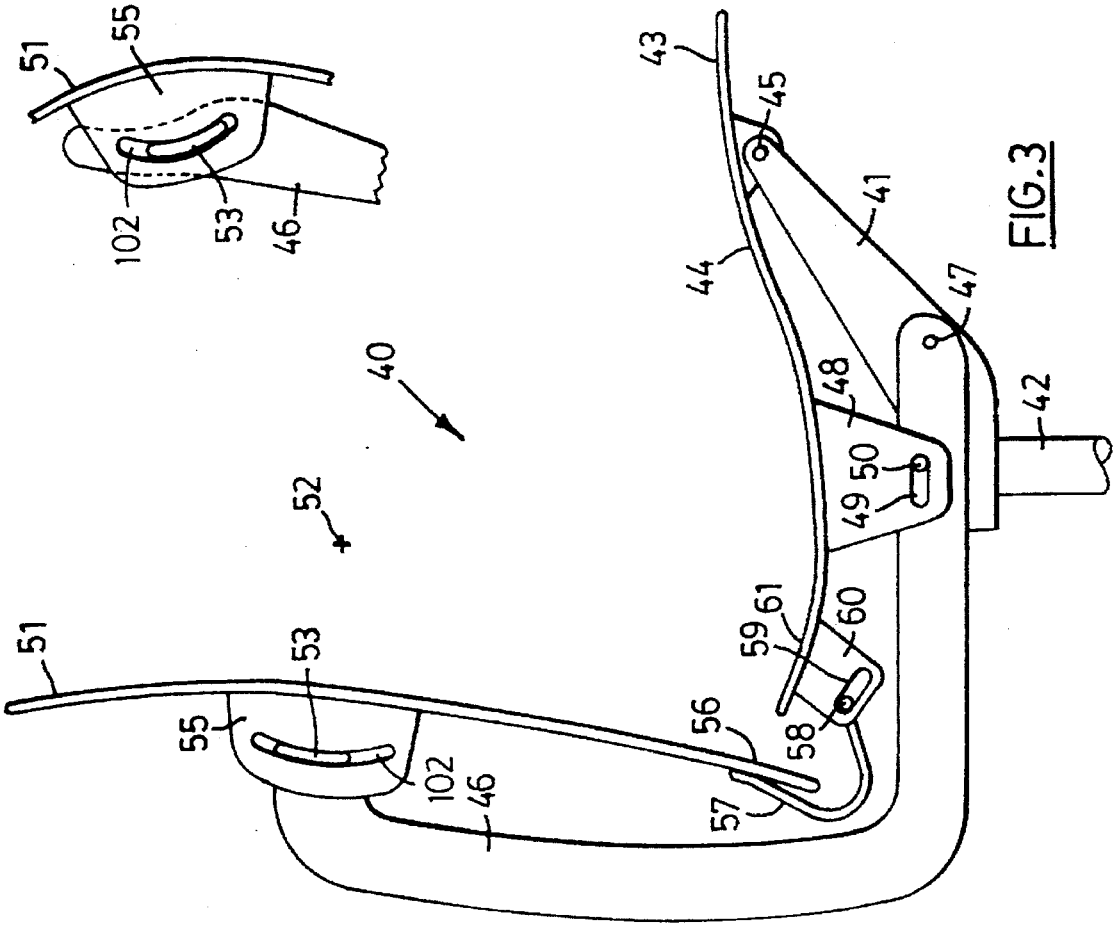
FIG. 3 is a diagrammatic cross-sectional representation of an embodiment of the present invention.

With reference to FIG. 3, the base of chair 40 comprises main bracket 41. Main bracket 41 is supported by a vertical column 42. Vertical column 42 is attached at its lower end to legs (not shown, but in a manner known to those skilled in the art). Typically there are from three to six legs, each of which may have casters. The front portion 43 of seat 44 is pivotally connected to main bracket 41 by a pivot 45. Back support means comprises a back bracket 46 which is pivoted about pivot 47 on main bracket 41. Pivot 47 is shown located forward of vertical column 42 but this is not necessary. Stoppers (not shown) may be present to limit the angular movement of the back bracket 46 with respect to the main bracket 41 as is known in the art. Seat 44 is connected to depending bracket 48, which extends under seat 44. Depending bracket 48 has a slot 49 therein which is approximately parallel to seat 44 or is approximately horizontal. Back bracket 46 has a pin or pins 50 fixed to it. Bracket 48 may be rigidly fixed to seat 44 or may be an integral part of seat 44. It should be noted that although the bracket is shown under the seat, it may be above or at the side of seat 44. Bracket 48, with slot 49, and back bracket 46 are aligned such the pin or pins 50 can slide freely in slot 49 for the entire range of seat movement.

The manner of fixing the seat to the main bracket 41 and the back bracket may also be different. Pivot 45 could be replaced with a sliding member, and bracket 48 and pin 50 may be replaced by a pivot. The seat may even be fixed at the front portion to the base and made of a flexible material so there is no need for a pivot. In such an instance the flexibility of the seat material is sufficient to allow the rear portion to move downwardly. Other means of pivoting will be obvious to those skilled in the art.

A back 51 is pivoted about point 52. Point 52 is an imaginary pivot fixed in space with respect to back bracket 46, such that in the vertical direction point 52 is approximately level with the upper lumbar of an average sized seated occupant, and in the front to back direction is approximately level with the mid point of the seated occupant's upper body. Movement of the chair back 51 about the imaginary pivot center 52 is made possible by the use of slot followers in the form of arc shaped segments, at least one of which 53. The arc shaped segment may be an integral part of chair back 46 or fixed to chair back 46 or an extensions thereof. For each arc shaped segment 53 there is a mating segment 55 which is fixed to or is an integral part of the back bracket 46. In FIG. 3A the mating segment comprises a plate 55 with an arcuate slot 102 therein, which mates with arc shaped segment 53. Arc shaped segment 53 has a shorter arc than arcuate slot 102 so that chair back 46 is free to rotate about pivot center 52, at least as far as the mating segment will allow. It will be understood by those skilled in the art that in an alternative embodiment the slot follower may be attached to back bracket 46 and the plate with slot may be attached to chair back 51. Arc shaped segment 53 may be replaced by at least two pins or similar, as will be understood by those skilled in the art.

At the bottom portion of the chair back 56, or to an extension of the same 57 (as shown in FIG. 3) there is a pin 58, which runs slidingly in a slot 59. Slot 59 is in a bracket 60 which is fixed to the rear portion 61 and below seat 44, or is an integral part of the seat. Slot 59 is oriented at between 10 and 90 degrees to the horizontal as shown (the forward end of the slot being lower than the rear end). Preferably slot 59 is a kidney shaped slot concave facing forward, and angled between 90 degrees to the horizontal at its upper and rear end and 10 degrees to the horizontal at its lower and forward end. Synchronous movement of the seat and the chair back allow the chair back to rotate about the imaginary pivot 52, and simultaneously allow pin 58 to slide in slot 59. When the chair is in its forwardmost or upright position, pin 58 is at the upper and rear end of the slot 59, and pin 50 is in the forwardmost position of slot 49 as shown in FIG. 3. When a biasing spring (not shown) is in the mechanism, it is normally located around or in the vicinity of pivot 47, and holds the chair in the full upright position as shown in FIG. 3. There may also be provided some means to adjust the tension of the spring such that the mechanism can be adapted to differing weights of users or their preferences of feel.

When a person sits in the chair and exerts a rearward force on chair back 51, back bracket 46 rotates about pivot 47. This allows rear portion 61 of seat 44 to incline about pivot 45, whilst pin 50 slides rearwardly in slot 49. At the same time chair back 51 pivots about imaginary pivot 52 and pin 58 at the bottom edge 56 of chair back 51 slides downwardly and forwardly in slot 59. The effect of this is that chair back 51 reclines at a faster rate compared to back bracket 46, and back bracket 46 reclines at a faster rate compared to seat 12, whilst the bottom portion of the chair back that moves in slot 59 makes the chair back as a whole come down and towards the seat. Because of the imaginary pivot point 52, the back of the chair 51 moves downward towards the seat as the chair reclines, giving the shortening of distance necessary to prevent shirt pull, or slip. The movement of pin 58 in slot 59 brings the lower portion 56 of the chair back towards the seat 44 in a predetermined and controlled manner, and prevents separation between the back of the occupant and the chair back thus providing support. Theoretically this movement can be extrapolated such that the seat and chair back will become parallel and there will essentially not be any displacement between them, i.e. they tend to conform to the natural movements of the body in the lying down position.

An alternate arrangement for rotating the chair back and moving the bottom of the chair back is shown in FIG. 4. Chair 62 comprises main bracket 63, seat 64, back 65 and back bracket 66. Seat 64 is pivotally connected to main bracket 63 at pivot 67. Back bracket 66 is pivotally connected to main bracket 63 at pivot 68. Main bracket 63 is supported by a vertical column 69. Vertical column 69 is attached at its lower end to legs (not shown). Thus far the description of the embodiment in FIG. 4 is similar to that shown in FIG. 3. The front of back 65 has a bracket 70 attached thereto. Bracket 70 extends in front of back 65 far enough for pivot 71 to be at a position similar to point 52 in FIG. 3, i.e. in the vertical direction pivot 71 is approximately level with the upper lumbar of an average sized seated occupant, and in the front to back direction is approximately level with the mid point of the seated occupant's upper body. The upper end of back bracket 66 extends forward with wing 72. Wing 72 and bracket 70 are pivotally connected at pivot 71. It will be understood that because wing 72 and bracket 70 are at the front of back 65 the plate and bracket has to be at the side of the chair in order to avoid poking into the occupant's back. Back 65 has a depending arm 73. At the lower end 74 of depending arm 73 there is a pin 75. Pin 75 slidingly engages with slot 76 in main bracket 63. In FIG. 4, slot 76 is shown as being arcuate, with a center somewhere above the rear of seat 64. It will be understood that the placement of the various pivot points and the positions and shapes of the various slots dictates the relative tilt rates of the back bracket and chair back. Simple experimentation will determine the best positions and shapes. The seat back in its reclined position is shown in dotted line form.

It will be understood by those skilled in the art that slidable connections may be made with devices other than the slot and pin arrangements described above. For example the pin may be replaced by a wheel or roller and the slot may be replaced by a channel or similar.

A further alternative titling mechanism is shown diagrammatically in FIG. 5. As shown, seat 80 and back portion 81 may be joined by a connecting element. The connecting element may consist of a link 82 which is hinged at one of its ends at the bottom portion of the chair back at 83 and at its other end hinged to the rear portion of the seat at 84. These hinges at 83 and 84 are preferably so-called live hinges. Link 82 is preferably made of thermoplastic polymeric material such as polyethylene. Preferred shapes of link 82 are those which allow the link to flex or collapse. For example, link 82 may be U-shaped or have slots therein to allow link to collapse in the lengthwise direction to assist in providing the relative motion of the bottom of chair back 83 and rear portion of seat 80. The double hinged collapsible connecting element merely replaces the pin, bracket, slot and chair back extensions described in relation to FIGS. 3 and 4.

A number of alternative devices may be added on to the mechanism, to give modified peripheral attributes. For example a stopper may be added to prevent the mechanism from going to its full forward position. An adjustable stopper may also be added to stop the mechanism in its reclined position. Further there may be additional devices to allow the height of the back of the chair to be adjusted in the vertical direction, and or the seat of the chair to be adjusted in the horizontal direction such that different user populations may be accommodated. However these and other modifications or additions are considered to be included in the spirit of this invention.

It is desirable that the occupant be supported and comfortable at all positions in the chair, from the upright or slightly forward inclined position to the fully reclined position. For this and other reasons it is preferred that the seat be contoured. Preferably, therefore, front end of the seat 90 is flat as shown by line 91 in FIG. 6, or slightly concave downwards, i.e. with the center portion near line 92 being higher than at the right and left edges 93 and 94 respectively. The rear end 95 of the seat is concave upwards in the lateral direction as shown by line 96 in FIG. 6. Line 92 in FIG. 6 shows the shape of seat 90 along its center line. This is a concave upward shape in the buttock area which flattens out and becomes concave downwards in the vicinity of line 91.

In another aspect of the invention the chair back is contoured. The general contour of the front of the chair back 97 may be as shown in FIG. 7. The longitudinal center line depicted by the line 98 is convex facing forward to give mild lordosis of the back. The area of the chair back adjacent to the central lumbar of the occupant is preferably concave forward as shown by the lateral line 99. The area shown by the lateral line 100, in the region of the lower back of the occupant may be either slightly convex facing forward as shown in FIG. 7, or straight. The area in the portion of the shoulder blades of the occupant, depicted by the lateral line 101 is preferably convex facing forward as in FIG. 7. Such contour supports the occupant in the lower back and lumbar regions whilst the upper back is supported mainly on the spinal area. The shoulder blades of the occupant may be allowed to flex slightly backwards in the lateral direction giving a very relaxed posture when inclined or fully supported when sitting erect. This is totally contrary to most chairs today, where the tendency is to have the area in the region of the shoulder blades to be concave facing forward.

In the foregoing description, it will be readily appreciated by those skilled in the art that modifications may be made to the invention without departing from the concepts disclosed herein.

I claim:

1. A chair for a person with an upper body and a back, in which the chair has upward and downward directions, forward and rearward directions and has a base, a chair seat, which has an underside, a chair back, and chair back support means; in which the chair seat has two sides, a front portion in the forward direction and a rear portion in the rearward direction; and in which the back support means is pivotable about a back support means axis which is forward of the rear portion of the seat and parallel to the side-to-side direction of the seat; in which the chair back has a top, a front which faces the forward direction, a rear which faces the rearward direction, a bottom which is downward relative to the top, and in which the bottom is closer to the rear portion of the seat than any other part of the chair back, an improvement wherein:

the chair back has rotation means for rotatable connecting the chair back to the back support means, the rotation being about a rotation axis which is parallel to the back support means axis, and which passes through the upper body of a person when the person is sitting on the seat and when the back of the person is resting against the front of the chair back, and wherein the seat is interconnected to the base and the back support means and wherein the bottom of the chair back is attached to means for moving the bottom downwardly and forwardly in a predetermined path as a result of rotation of the chair back rotation means in a first direction, and upwardly and backwardly in a predetermined path as a result of rotation of the chair back rotation means in a direction reverse to said first direction, said interconnection means being selected from the group consisting of i) first pivot means at the front portion of the seat for pivotally connecting the front portion of the seat to the base, second pivot means for pivotally connecting the back support means to the base, and first slidable connection means for slidably connecting the seat to the back support means and allowing relative movement at the first slidable connection means of the seat and back support means in a direction substantially parallel to the forward and rearward direction, ii) first pivot means for pivotably connecting the seat to the back support means, second pivot means for pivotally connecting the back support means to the base, and first slidable connection means at the front portion of the seat for slidably connecting the front portion of the seat to the base and allowing relative movement at the first slidable connecting means of the seat and base in a direction substantially parallel to the forward and rearward direction and iii) first pivot means at the front portion of the seat for pivotally connecting the front portion of the seat to the base, first slidable connection means for slidably connecting the back support means to the base, and second pivot means for pivotally connecting the seat to the back support means and allowing relative movement at the first slidable connection means of the back support means and the base in a direction substantially parallel to the forward and rearward direction; and translation means for allowing simultaneous movement of the bottom of the chair back along a path between a first position to a second position which is downward and forward of the first position.

2. A chair according to claim 1 wherein the front portion of the seat has first pivot means for pivotally connecting the front portion of the seat to the base, and the underside of the seat has a first slidable connection means for slidably connecting the underside of the seat to the back support means and allowing relative movement of the seat and back support means in a direction substantially parallel to the forward and rearward direction; and the back support means has second pivot means for pivotally connecting the back support means to the base.

3. A chair according to claim 1 wherein the translation means comprises a depending arm attached to the chair back, in which the depending arm has an end which is distal to the rotation means, and in which the end has second slidable connection means for slidably connecting the end to a member, said member being selected from the group consisting of the base and an appendage attached to the rear portion of the seat, said second slidable connection allowing movement of the end of the depending arm along a path between the first position and the second position.

4. A chair according to claim 3 wherein the end of the depending arm is slidably connected to the base.

5. A chair according to claim 3 wherein the end of the depending arm is slidably connected to an appendage attached under the rear portion of the seat.

6. A chair according to claim 3 wherein the path between the first and second positions of the second slidable connection means is in an arc which is concave towards a position above the seat and forward.

7. A chair according to claim 3 wherein the second slidable connection means is a mating slot and slot follower.

8. A chair according to claim 1 wherein the rotation means comprises i) an arcuate slot in a plate, in which the slot has a center of the arc at the rotation axis, and ii) a mating slot follower, in which one of the plate and the slot follower is attached to the chair back and the other of the plate and slot follower is attached to the back support means, said arcuate slot being at the rear of the chair back.

9. A chair according to claim 8 wherein the slot follower is selected from the group consisting of i) an arcuate protuberance of smaller arc length than the slot and ii) at least two pins.

10. A chair according to claim 8 wherein the rotation means comprises third pivot means in which the back support means and the chair back are pivotally connected at the rotation axis.

11. A chair according to claim 8 wherein the path between the first and second positions of the second slidable connection means is in an arc which is concave towards a position above the seat and forward.

12. A chair according to claim 1 wherein the axis of rotation of the chair back rotation means is substantially level with an upper lumbar region of the person's back.

13. A chair according to claim 12 wherein the front portion of the seat has first pivot means for pivotally connecting the front portion of the seat to the base, and the underside of the seat has a first slidable connection means for slidably connecting the underside of the seat to the back support means and allowing relative movement of the seat and back support means in a direction substantially parallel to the forward and rearward direction; and the back support means has second pivot means for pivotally connecting the back support means to the base.

* * * * *